US012076785B2

(12) United States Patent
Tipton et al.

(10) Patent No.: US 12,076,785 B2
(45) Date of Patent: Sep. 3, 2024

(54) DOSING PUMP TRIGGER SYSTEM

(71) Applicant: PYROTEK, INC., Spokane, WA (US)

(72) Inventors: Jon Tipton, Aurora, OH (US); Andrew Horsfall, Aurora, OH (US)

(73) Assignee: PYROTEK, INC., Spokane, WA (US)

( * ) Notice: Subject to any disclaimer, the term of this patent is extended or adjusted under 35 U.S.C. 154(b) by 88 days.

(21) Appl. No.: 17/619,109

(22) PCT Filed: Jun. 10, 2020

(86) PCT No.: PCT/US2020/037026

§ 371 (c)(1),
(2) Date: Dec. 14, 2021

(87) PCT Pub. No.: WO2020/252044

PCT Pub. Date: Dec. 17, 2020

(65) Prior Publication Data

US 2022/0266334 A1 Aug. 25, 2022

Related U.S. Application Data

(60) Provisional application No. 62/861,793, filed on Jun. 14, 2019.

(51) Int. Cl.
*B22D 39/02* (2006.01)

(52) U.S. Cl.
CPC ..... *B22D 39/02* (2013.01)

(58) Field of Classification Search
CPC ..... B22D 17/30; B22D 39/02; B22D 39/023
USPC ..... 222/590
See application file for complete search history.

(56) References Cited

U.S. PATENT DOCUMENTS

| | | | |
|---|---|---|---|
| 2016/0193652 A1 | 7/2016 | Kikuchi | |
| 2017/0246681 A1 | 8/2017 | Tipton et al. | |
| 2022/0266334 A1* | 8/2022 | Tipton | B22D 17/30 |

FOREIGN PATENT DOCUMENTS

| | | | |
|---|---|---|---|
| EP | 0126797 | A1 * | 12/1984 |
| JP | 2012101275 | A | 5/2012 |
| KR | 20140013450 | A | 2/2014 |
| KR | 20160064492 | A | 6/2016 |

OTHER PUBLICATIONS

International Search Report on Application No. PCT/US2020/037026, Mailed Sep. 11, 2020, 2 pages.

* cited by examiner

*Primary Examiner* — Jessee R Roe
*Assistant Examiner* — Michael Aboagye
(74) *Attorney, Agent, or Firm* — Lippes Mathias LLP

(57) ABSTRACT

A method for delivering molten metal to a shot sleeve of a casting machine from a molten metal furnace. A molten metal pump is positioned within the furnace. The pump includes a molten metal outlet in fluid communication with the shot sleeve. A shaft and impeller or screw assembly of the pump is selectively rotated to introduce molten metal to the shot sleeve in a predetermined quantity. The predetermined quantity is determined by a controller that receives a signal from a trigger mechanism associated with the molten metal outlet.

12 Claims, 7 Drawing Sheets

DOSING PUMP TRIGGER SYSTEM

This application claims the benefit of U.S. Provisional Application No. 62/861,793 filed Jun. 14, 2019, the disclosure of which is herein incorporated by reference.

BACKGROUND

The present exemplary embodiment relates to a process and apparatus for delivering a measured shot of molten metal. It finds particular application in conjunction with a shot sleeve of a die casting machine and will be described with particular reference thereto. However, it is to be appreciated that the present exemplary embodiment is also amenable to other similar applications including delivery of a measured shot to a pour cup, ladle, or mold.

In die casting of non-ferrous (e.g. aluminum) products metal is melted in a furnace. The molten metal is stored in a molten state ready for delivery to a mold. A metered amount of molten metal is delivered to the mold. Several devices have been proposed which will deliver a metered amount of molten metal (a shot) to the mold. For example, ladeling, magnetic pumps and pressurized furnaces have been employed.

One example of a pressurized furnace is described in U.S. Pat. No. 2,846,740 (the disclosure of which is herein incorporated by reference). The system comprises a crucible communicating with a balance tube and a delivery tube. The balance tube communicates with the molten metal of a furnace and the crucible. The delivery tube communicates with the crucible for delivery of the shot to the mold cavity. The crucible is initially unpressurized. The molten metal inside the crucible is level with a top of the balance tube. The top of the balance tube is slightly above the maximum level of molten metal within the furnace. Air is forced into the crucible and forces the molten metal through the delivery tube into a launder. The amount of metal delivered is controlled by an adjustable timer. Once a predetermined time period has elapsed, a vacuum is applied to the crucible drawing molten metal from both the balance tube and the delivery tube. Molten metal is drawn into the crucible until its level is above the height of the balance tube. The crucible is then vented to the atmosphere allowing the metal to as the height of the balance tube. Unfortunately, the delivery and balance tubes of these apparatus can degrade over time and/or leak, resulting in poor shot size control.

Developments have been made in order to increase the accuracy of the quantity of shot delivered. One such device is described in U.S. Pat. No. 4,220,319 (the disclosure of which is herein incorporated by reference). In this device, complicated sequences of varying pressures over predetermined time periods are used. The pressure sequences are designed to compensate for smaller amounts of metal being delivered due to the gradual lowering of the level of molten metal in the dosing chamber. However, such devices are complicated, expensive to manufacture and can be difficult to operate.

A further example of a dosing chamber is provided by U.S. Pat. No. 6,426,037, the disclosure of which is herein incorporated by reference. Referring to FIG. 1, a molten metal dosing chamber is shown. The dosing chamber is insertable within the metal holding chamber 5 of a molten metal furnace, generally identified 1. The chamber 10 may be insertable through a shell opening 7 situated in one side of the holding furnace shell 2 or through the top opening 8 of the furnace 1. The shell opening 7 is sealable by means of a refractory plug 3. The dosing chamber 10 is shown in a horizontal orientation and includes a first end portion 11, a top portion 12, a bottom portion 13 and a second end portion 14 form a chamber cavity 17 which is functionally adapted to hold and retain molten metal within its walls. Portion 11 includes a clean out port 26 and plug 27. Gas inlet port 23 is provided in the top chamber portion 12. The inlet port 23 is fitted with a seat 24 including a chamfered inner surface 25 which is functionally adapted to receive the end of a stopper tube 31. It is through this stopper tube 31 that an inert gas, such as nitrogen, is introduced to cavity 17. Near the second end 14 of the top surface 12 a metal outlet port 22 is provided. The metal outlet port 22 includes a sealing shoulder 21 which is functionally adapted to be engageable with the filling end 41 of a stalk tube 42 including discharge spout 43 and metering orifice and flow sensor 44. The stopper tube 31 is vertically movable by virtue of the actuating assembly 36, 37.

As molten metal fills the metal holding chamber 5, molten metal pours into and fills the inner cavity 17 of the dosing chamber 10. The stopper tube 31 is then actuated to lower the bottom most tip into sealing engagement with the seat 24. With the lower end 41 of the stalk tube 42 located over the metal outlet port 22, the dosing chamber 10 is ready to have a predetermined volume of gas introduced through the gas delivery line 34 and into the dosing chamber cavity 17. Since the gas will assume and fill the higher portions of the dosing chamber cavity 17, the molten metal contained within the cavity 17 will be forced out of the dosing chamber 10 via the outlet port 22. The molten metal will then travel up the stalk tube 42 and out to the exterior of the furnace 1 to a pour cup, shot sleeve or other similar device 51. The system of FIG. 1 suffers from drawbacks including variations in efficiency resulting from degradation of the gas introduction components, the fact that a closed system is hard to refill, the fact that compressibility of gas degrades precision, and the requirement that a significant amount of space is consumed.

The present disclosure contemplates the use of a mechanical pump as a mechanism to deliver a measured quantity of molten metal to a die casting mold. Although centrifugal pumps operate satisfactorily to pump molten metal, they have not been widely used as a means to fill a die casting mold shot sleeve. Rather, as demonstrated above, this task has been left to magnetic pumps, pressurized furnaces and ladeling.

Centrifugal pumps generally control a flow rate and pressure of molten metal by modulating the rotational rate of the impeller and therefore offer the advantage of responsiveness achieved via direct mechanical interaction with the molten metal. However, RPM control as a mechanism to regulate flow rate and pressure of molten metal transfer has previously not been considered adequate for dispensing a metered quantity of molten metal to a shot sleeve. As recognized by the skilled artisan, the short fill or over fill of a mold can have catastrophic consequences.

U.S. Published Application No. 2017/0246681, the disclosure of which is herein incorporated by reference, discloses a system for filling the shot sleeve of a molding machine. While the details of this disclosure provide a viable mechanism for molten metal molding, it fails to fully address certain variables in the overall molding machine system, including variability of metal level in the furnace and filter efficiency. The present disclosure helps to address these shortcomings.

BRIEF DESCRIPTION

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In one embodiment, a molding machine comprising a cavity to be filled with molten metal is provided. A conduit system leads to the cavity and forms a system of interconnected hollow spaces. A pump is provided in fluid communication with a reservoir of molten metal and the conduit system. At least one trigger mechanism is provided in association with the conduit system. The trigger mechanism is configured to determine when molten metal has entered a defined point in the conduit system.

In another embodiment, a method for delivering molten metal to a shot sleeve of a casting machine is provided. The method includes the steps of providing a molten metal furnace having a refractory lining for holding the molten material therein, introducing a molten metal pump into the furnace, providing the pump with a molten metal outlet conduit in fluid communication with the shot sleeve, and selectively rotating a shaft and impeller or screw assembly of the pump to introduce molten metal to the shot sleeve in a predetermined quantity. The predetermined quantity is determined by a controller that receives a signal from a trigger mechanism associated with the molten metal outlet conduit.

According to a further embodiment, a dosing pump suitable for introducing molten metal is provided. The pump includes a base housing an impeller arranged to output the molten metal. The impeller is connected to a shaft. The shaft is connected to a motor. The motor includes an inverter in communication with a controller. The controller includes a software program configured to modify RPM based upon input from a triggering mechanism such that a predetermined quantity of the molten metal is delivered. The triggering mechanism is positioned on an outlet leg of the pump.

DETAILED DESCRIPTION

It is to be understood that the detailed figures are for purposes of illustrating the exemplary embodiments only and are not intended to be limiting. Additionally, it will be appreciated that the drawings are not to scale and that portions of certain elements may be exaggerated for the purpose of clarity and ease of illustration.

The use of a centrifugal molten metal pump in the process of die casting is highly challenging. A typical die casting cycle time is 30 to 90 seconds, which requires a shot sleeve to be filled in approximately 3 to 10 seconds. For small quantities of metal, gravity feed devices may be satisfactory. However, when a large quantity of metal is being cast, e.g. >50 lbs. or >100 lbs., forced flow is advantageous.

It maybe desirable to provide an initial "slow" speed fill period (e.g. ¼ cycle time), and a second relatively higher speed fill period (e.g. ½ cycle time), and a relatively slower ramp down cycle (e.g. ¼ cycle time). Furthermore, the delivered quantity of molten metal should be within about 2% of the expected quantity. The present disclosure is directed to a system that can fulfill these requirements.

Figure 1:
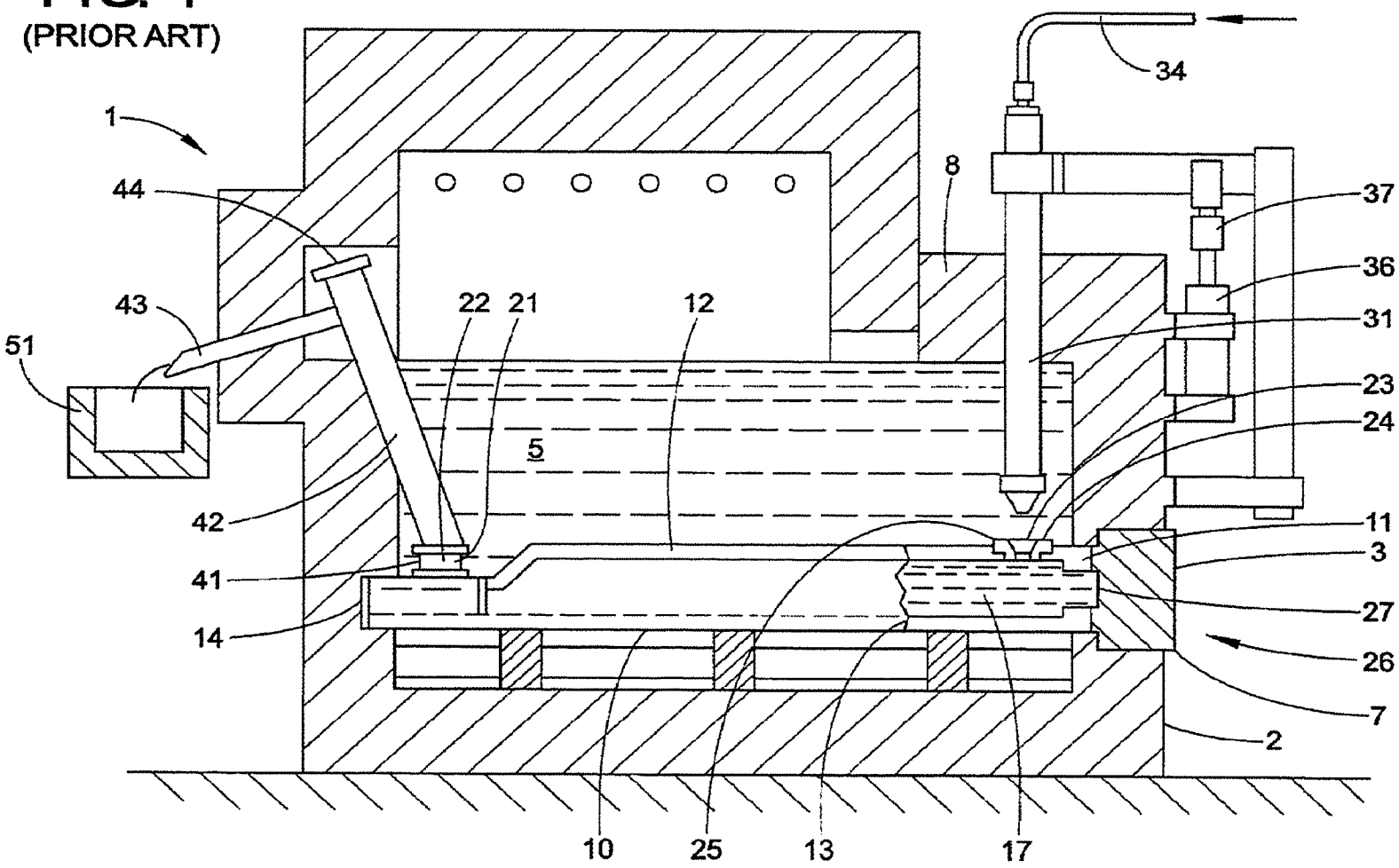
FIG. 1 (PRIOR ART)
FIG. 1 is a front view of a prior art dosing assembly.
Figure 2:
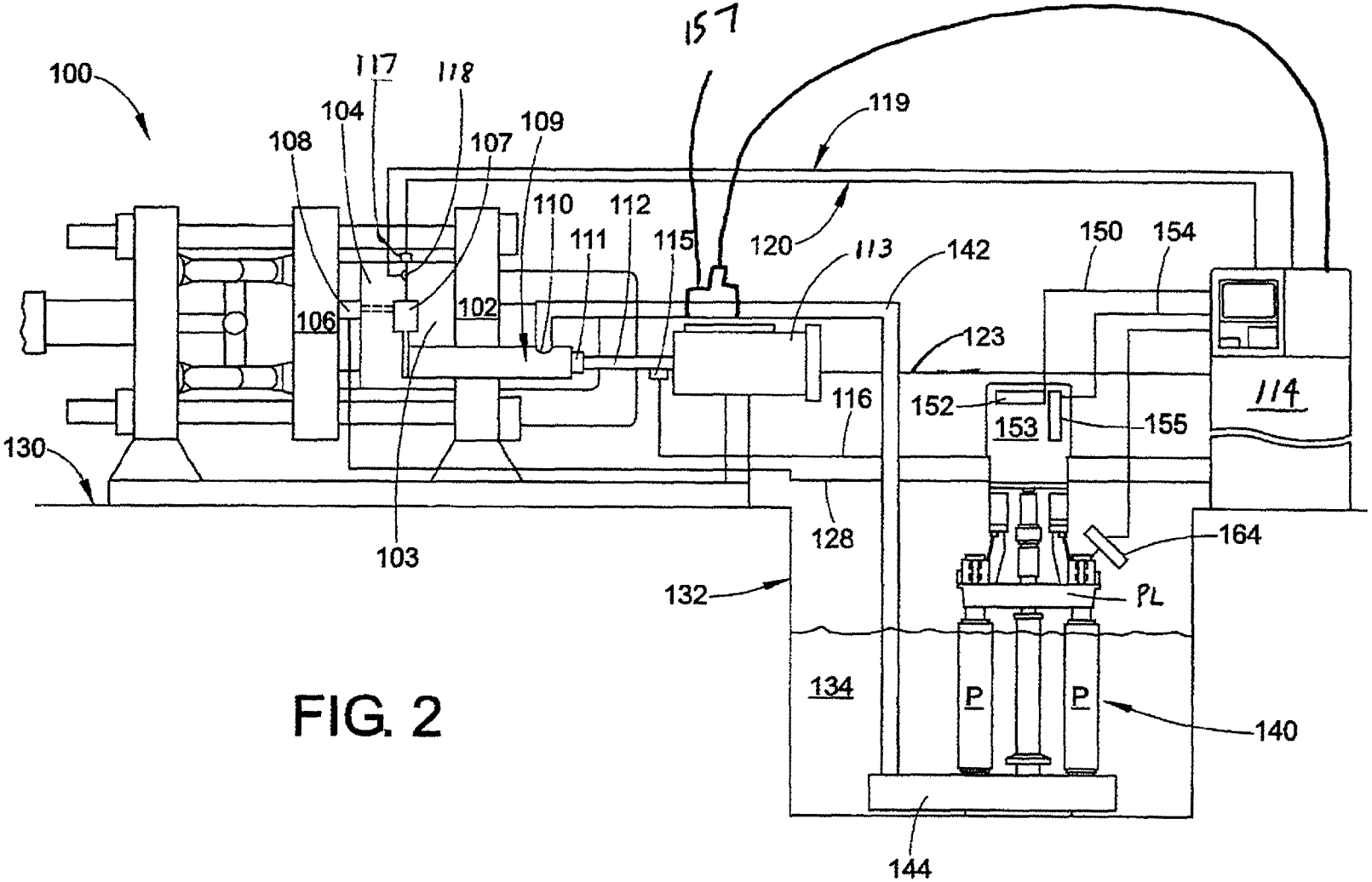
FIG. 2 is a schematic illustration of a die casting apparatus.

With reference to FIG. 2, a die casting machine 100 comprises a stationary die clamping plate 102 onto which a stationary die half 103 is mounted. This stationary die half 103 together with a moveable die half 104, fastened to a moveable die clamping plate 106, define a die cavity 107. An external after-pressure arrangement 108 can be optionally added to the die cavity 107. After pressure arrangement 108 can be linked to a control unit 114 by a data communication line 128.

A shot sleeve 109 having a filling hole 110 is fastened to the stationary die half 103. A casting piston 111 is displaceable in this shot sleeve 109 by means of a hydraulic drive unit 113 which acts upon its piston rod 112 in order to press metal, that has been filled into the shot sleeve 109 through the filling hole 110, into the die cavity 107. The hydraulic drive unit 113 is controlled by control unit 114 via data communication line 123 which may encompass both electric-electronic components as well as at least part of the hydraulics. To this end, a position sensor and or velocity sensor and/or acceleration sensor 115 as well as other sensors, such as pressure sensors, are coupled to the control unit 114 via data communication line 116, as is known.

A vacuum valve 117 may be provided within the region of the parting plane of both die halves 103, 104. Vacuum valve 117 can be controlled, in the present case, by a quickly reacting metal front sensor 118 interfaced with control unit 114 via data communication line 119. The reaction speed of this sensor 118 is such that the valve is still able to close a vacuum conduit 120 in the region of the die halves 103, 104 within a time period which passes up to the moment when the metal arrives from the sensor 118 to the valve 117. The vacuum conduit 120, instead of comprising a separate control unit which includes a vacuum pump and a vacuum tank (as a vacuum source) and so on, is advantageously coupled to that control unit 114 which also controls the movement of the casting piston 111 so that the parts belonging to the control of the evacuation device are accommodated in the housing where the control unit of the piston 111 are mounted, and no separate control parts have to be provided.

In a typical die casting establishment, the die casting machine 100 is disposed on a floor 130 into which a molten metal receiving well 132 can be formed. Molten metal well receiving well 132 is in fluid communication with a refractory furnace from which molten metal 134 is received. Of course a variety of alternative molten metal retention environments exists, such as, for example, a well in which molten metal is deposited from a remote furnace location via transporting equipment. It would similarly be feasible for molten metal to be delivered to the well via launder system. Nonetheless, the present invention is directed to the utilization of a centrifugal pump 140 to provide molten metal via a conduit 142 extending between the molten metal base 144 to the die casting fill hole 110. It is noted that the run of conduit 142 in FIG. 2 appears lengthy but this depiction is provided only to illustrate the details of the various components. Moreover, it is envisioned that the pump and shot sleeve in practice will be situated significantly closer to one another. Molten metal pump 140 can be the type disclosed in US 2014/0044520, the disclosure which is herein incorporated by reference.

Molten metal pump 140 is in communication with the controller 114. For example, data communication line 150 can be provided between an inverter 152 and the controller 114. Similarly, a data communication line 154 can be provided between an RPM sensing device, such as an encoder 155, and the controller 114. A further input to controller 114 is provided from trigger mechanism 157. Trigger mechanism 157 can be a laser, a thermocouple, a molten metal switch, a pressure sensor, or another device capable of determining when molten metal is present at the defined location in conduit 142.

The trigger mechanism can be particularly useful in calculating a quantity of molten metal provided to the shot sleeve. Moreover, while the theoretical volume of molten metal transferred by the centrifugal pump at a particular RPM can be known, reality often deviates from the theoretical based on molten metal reservoir depth in the furnace in which the pump is disposed and the efficiency of the pump filter which degrades over time. By providing a trigger mechanism to advise the controller when molten metal has reached and/or is passing by a point on the outlet conduit, a more precise determination of cycle time to achieve the desired shot sleeve (or other type of vessel) fill quantity is feasible. In certain embodiments, the trigger mechanism may determine both molten metal flow and rate.

In this regard, the present mold and/or shot sleeve fill profile can include the initial slow speed fill period, a second relatively higher speed fill period, and an optional third relatively slower speed fill period. The trigger mechanism can be used to signal the controller when molten metal has reached a defined location in the conduit between pump and mold/shot sleeve. Moreover, the trigger mechanism instructs the controller when the fill profile can be initiated to deliver a quantity of molten metal within about 2% of the expected quantity. The trigger mechanism is advantageous because pump filter efficiency and molten metal depth in the furnace can influence the distance molten metal advances down the conduit system between pours and the location of the molten metal when the fill cycle is initiated can influence the quantity of molten metal introduced to the mold and/or shot sleeve. In short, starting the mold fill process when the metal column is at the triggering mechanism improves the quality of the casting process.

The controller 114 is used to adjust the RPM of the pump motor 153. By controlling the pump RPM, the shot size and rate of molten metal flow can be controlled. A typical control system will include a programmable logic controller (PLC), a human—machine interface (HMI), and an inverter. An electronic motor encoder 155 may also be present to provide the PLC with a feedback loop coupled with the inverter to monitor pump speed. The motor illustrated in FIG. 2 is a 3-phase variable frequency drive inverter. However, a DC servo motor would be equally suitable.

A precise shot weight can be provided by employing a feedback loop logic control. The PLC logic includes a command speed sent to the pump motor, then utilizing a RPM sensing device, the speed of the pump motor is relayed to the PLC and verified. The triggering mechanism provides further information and verification of programmed instructions. The PLC program then makes adjustments to the command speed of the pump motor. This cycle is repeated many times per second for accurate RPM control of the pump motor.

Some of the parameters used to calculate the shot volume/quantity can include: 1) cycle time in seconds; 2) RPM of the pump motor; and 3) timing and velocity of molten metal flow in the conduit proximate the shot sleeve; and 4) evaluation of the inverter settings including acceleration, deceleration, speed feedback calculating parameters (other conditions may also be monitored).

The controller can also be in communication with a sensor such as laser sensor 164 (see FIG. 2) to determine the molten metal bath level within the associated furnace. Moreover, it is believed that molten metal depth may be an important variable effecting shot sleeve fill. Accordingly, the PLC receiving data concerning molten metal depth level will adjust the pump RPM appropriately.

The programming of the shot weight can be automatically calculated from data tables included in the controller programming based on time of fill that an operator inputs via the HMI. The operator can manually adjust the shot weight by changing the RPM on one or more entry points and/or the system can use feedback from the die cast machine where, for example, biscuit length is communicated to the controller and fill cycle points automatically adjusted to achieve the correct fill shot weight. (A biscuit is the remaining metal in a shot sleeve after the molten metal is rammed into the die).

Accordingly, the present system may include automatic RPM adjustment features dictated by feedback from the trigger mechanism, the pump inverter and optionally an encoder which are each instructive on the relative performance of the pump. Similarly, automatic RPM adjustment may be made in view of other sensed conditions such as molten metal depth and/or biscuit size. In addition, the system can be manually adjusted by an operator using the HMI of the controller.

Figure 3:
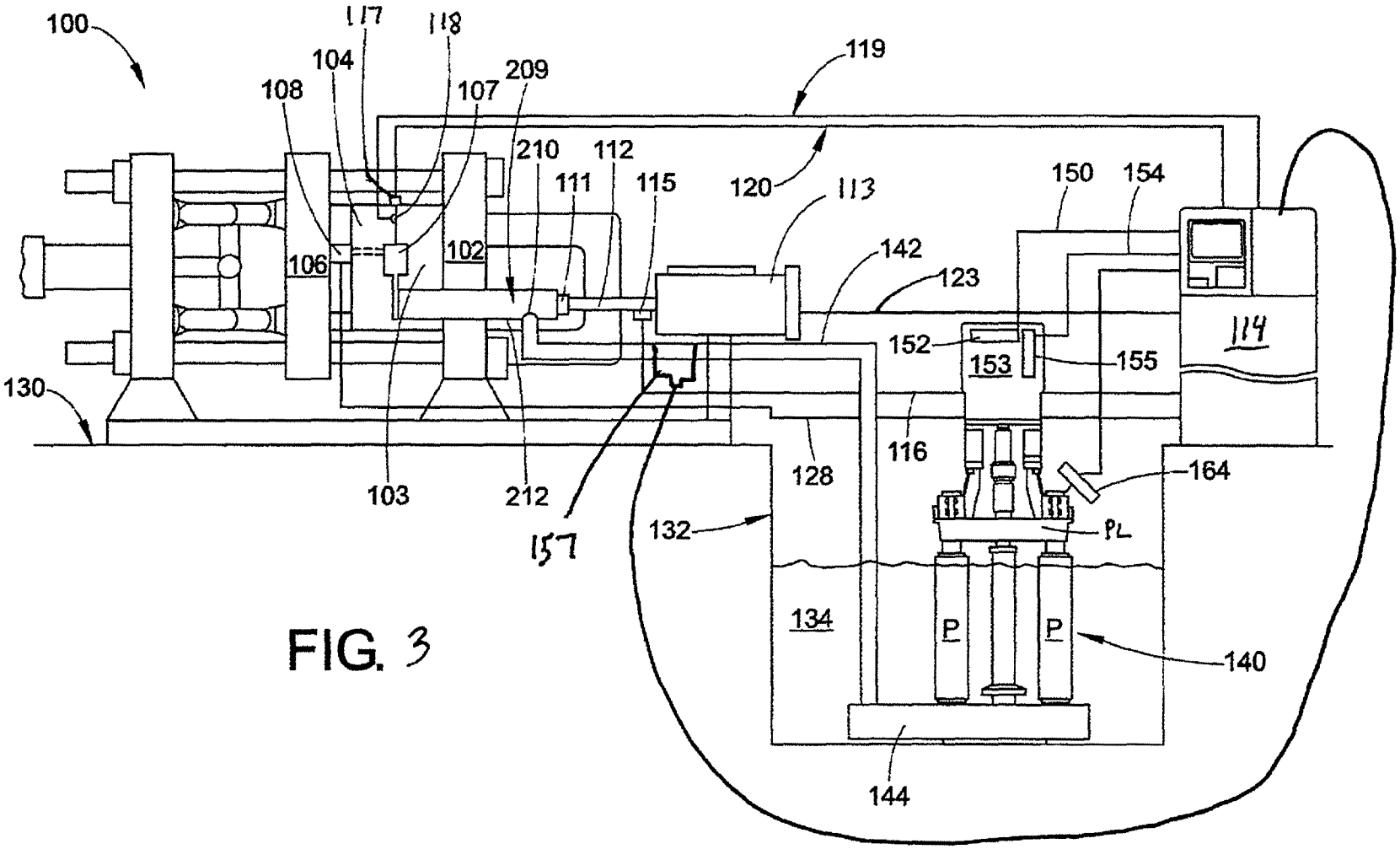
FIG. 3 is a schematic illustration of an alternative configuration of a die casting apparatus.

With reference to FIG. 3, an alternative bottom feed shot sleeve embodiment is depicted. The depicted apparatus is largely the same as shown in FIG. 2. Accordingly, much of the associated numbering has been retained. However, in this embodiment, a shot sleeve 209 having a filling hole 210 located in a lower surface 212 is provided. This design is considered highly beneficial because it facilitates low turbulence filling of the shot sleeve and associated improved metal quality. Moreover, by providing the molten metal inlet to the shot sleeve in a lower half thereof, a relatively low turbulence fill can be performed. It is noted that the present use of a centrifugal pump to provide molten metal directly to the shot sleeve allows for a lower half inlet, a feature not easily achievable via a ladle fill or pressurized furnace.

It is also noted that the present pump is considered suitable for use with any type of casting apparatus. Moreover, it can be used in vertical and horizontal casting. Furthermore, it can be used with a vertical or horizontally oriented shot sleeve. Similarly, it can be used with a sleeve having a top, bottom or side inlet location and wherein the shot sleeve is in any orientation. Advantageously, this allows die casting operators significantly greater flexibility in the design layout of a casting apparatus and/or multiple casting apparatus.

Figure 4:
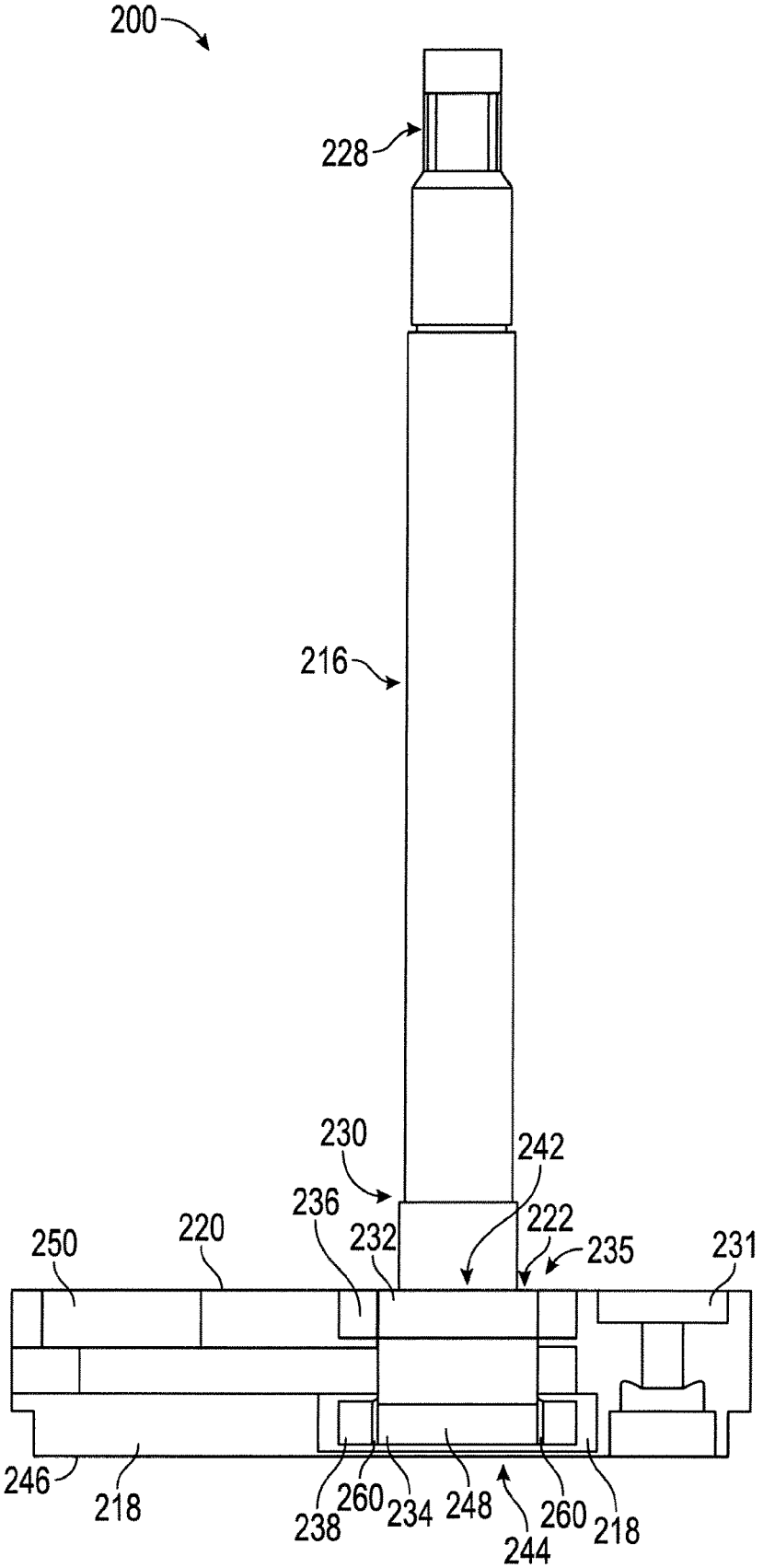
FIG. 4 is a cross sectional view of the centrifugal pump of the present disclosure.

With reference to FIG. 4, elements of the molten metal pump assembly 200 of the present disclosure are illustrated. More particularly, the elongated shaft 216 includes a cylindrically shaped elongated orientation having a rotational axis that is generally perpendicular to the base member 220. The elongated shaft has a proximal end 228 that is adapted to attach to the motor and a distal end 230 that is connected to the impeller 222. Impeller 222 is rotatably positioned within the pump chamber 218 such that operation of the motor rotates the elongated shaft 216 and the impeller 222 within the pump chamber 218. In certain embodiments, it may be advantageous to provide the motor controlling the rotation of the molten metal shaft with an electronic brake.

The base member 220 defines the pump chamber 218 that rotatably receives the impeller 222. The base member 220 is configured to structurally receive the refractory posts P (see FIG. 2) through passages 231. Each passage 231 is adapted to receive the metal rod component of the refractory post to rigidly attach to a platform PL (see FIG. 2). The platform supports the motor 153 above the molten metal.

In one embodiment, the impeller 222 is configured with a first radial edge 232 that is axially spaced from a second radial edge 234. The first and second radial edges 232, 234 are located peripherally about the circumference of the impeller 222. The radial edges may be formed of the impeller body (e.g. graphite) or may be bearing rings (e.g. silicon carbide) seated to the impeller body. The pump chamber 218 includes a bearing assembly 235 having a first bearing ring 236 spaced from a second bearing ring 238. The first radial edge 232 is facially aligned with the first bearing ring 236 and the second radial edge 234 is facially aligned with the second bearing ring 238. The bearing rings are made of a material, such as silicon carbide, having frictional bearing properties at high temperatures to prevent cyclic failure due to high frictional forces. One of the bearings is adapted to support the rotation of the impeller 222 within the base member such that the pump assembly does not experience excessive vibration. More precisely, one bear ring has a close tolerance with the impeller radial edge to reduce excessive vibration. The second bearing ring is spaced from the radial edge of the impeller and provides a wear surface for the leakage path described below. The radial edges (or bearing ring seated thereon) of the impeller may similarly be comprised of a material such as silicon carbide. For example, the radial edges of the impeller 222 may be comprised of a silicon carbide bearing ring.

In one embodiment, the impeller 222 includes a first peripheral circumference 242 axially spaced from a second peripheral circumference 244. The elongated shaft 216 is attached to the impeller 222 at the first peripheral circumference 242. The second peripheral circumference 244 is spaced opposite from the first peripheral circumference 244 and aligned with a bottom surface 246 of the base member 220. The first radial edge 232 is adjacent to the first peripheral circumference 242 and the second radial edge 234 is adjacent to the second peripheral circumference 244.

A bottom inlet 248 is provided in the second peripheral circumference 244. More particularly, the inlet comprises the annulus of a bird cage style of impeller 222. Of course, the inlet can be formed of vanes, bores, or other assemblies known in the art. As will be apparent from the following discussion, a bored or bird cage impeller may be advantageous because they include a defined radial edge allowing a designed tolerance (or bypass gap) to be created within the pump chamber 218. The rotation of the impeller 222 draws molten metal into the inlet 248 and into the chamber 218 and the continued rotation of the impeller 222 causes molten metal to be forced out of the pump chamber 218 to an outlet 250 of the base member 220. Outlet 250 can be in fluid communication with conduit 142 (see FIG. 2). Typically, the bottom inlet will be guarded by a filter.

A close tolerance is maintained between radial edge 232 of the impeller 222 and the first bearing ring 236 of the bearing assembly 235. For example, the first radial edge 232 surrounds the first bearing ring 236 such that the radial edge 232 rotates while maintaining contact with bearing ring 236 to provide rotational and structural support to the impeller 222 within the chamber 218. It is envisioned that such contact may be in the form of a thin lubricating layer of molten metal.

A bypass gap 260 is provided to manipulate a flow rate and a head pressure of the molten metal. The bypass gap 260 allows molten metal to leak from the pump chamber 218 to an environment outside of the base member 220 at a predetermined rate. Moreover, the predetermined rate can be controlled by the relative size of the bypass gap. The leakage of molten metal from the pump chamber 218 during the operation of the pump assembly allows an associated user to finely tune the flow rate or volumetric amount of molten metal provided to the associated shot sleeve. The leakage rate of molten metal through the bypass gap 260 improves the controllability of the transport of molten metal and is at least in part because a static hold condition can be maintained while the impeller shaft assembly rotates.

The bypass gap 260 can be formed by the second bearing ring 238 wherein the second bearing ring 238 includes a larger internal diameter than the external diameter of the second radial edge 234. Moreover, it is envisioned that one of the two bearing sets has a radial edge engaging and rotatably supported against the bearing ring while the other radial edge is spaced from the associated bearing ring to provide a bypass gap. Optionally, it is contemplated that the bypass gap 260 may be provided between the first radial edge 232 and the first bearing ring 236.

In one embodiment, operation of the pump assembly of the present disclosure includes an ability to statically position molten metal pumped through the outlet at approximately 1.5 feet of head pressure above a body of molten metal. In one embodiment the impeller rotates approximately 850-1000 rotations per minute such that molten metal is statically held at approximately 1.5 feet above the body of molten metal. The bypass gap manipulates the volumetric flow rate and head pressure relationship of the pump such that an increased amount of rotations per minute of the impeller would allow the reduction of head pressure as the flow rate of molten metal is increased.

Figure 5:
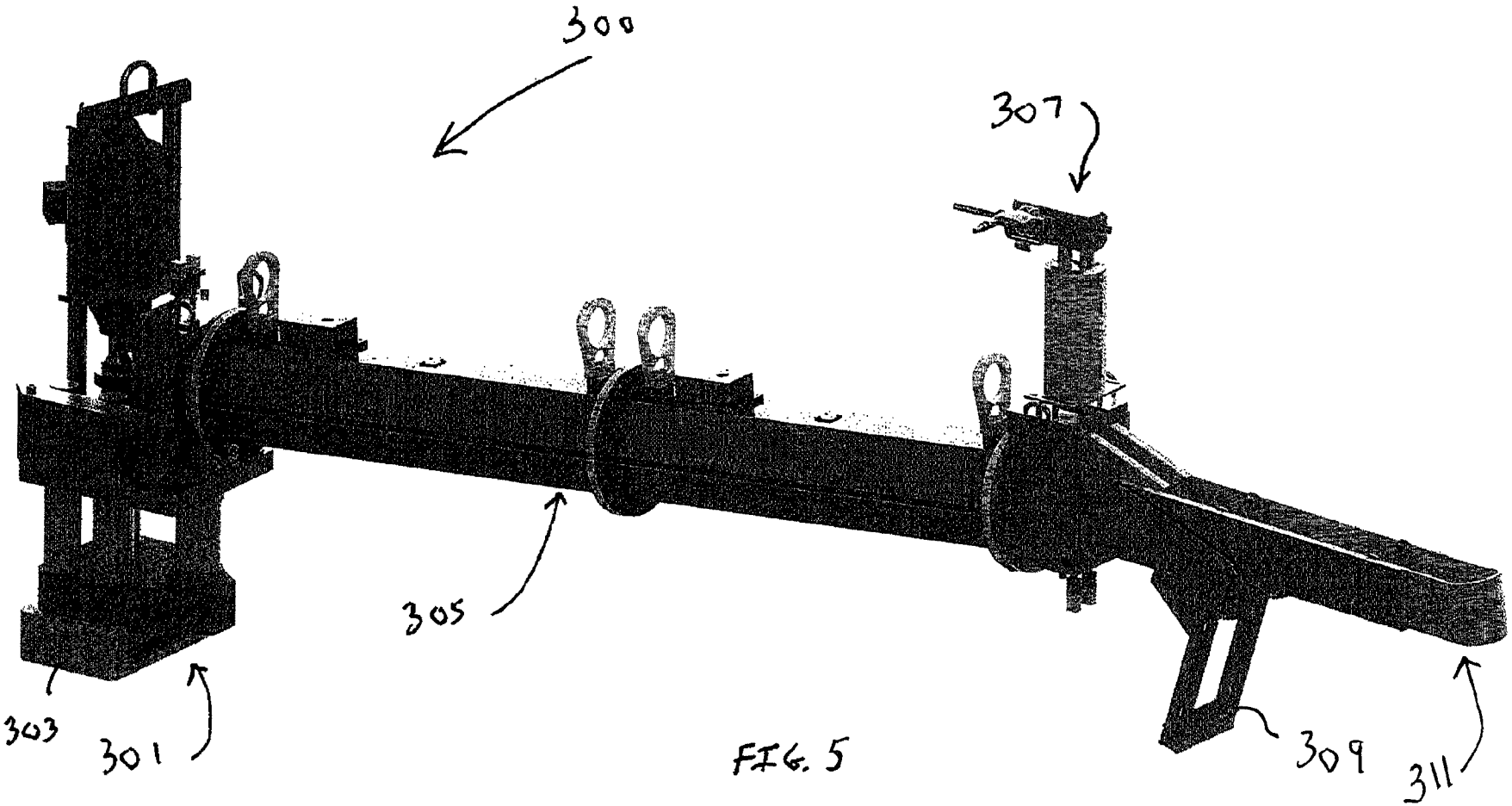
FIG. 5 is a perspective view of a trigger mechanism in association with a heated launder tube of the die casting apparatus.

Turning now to FIG. 5, a molten metal pumping device 300 is depicted. Device 300 is suitable for feeding molten metal to a die casting apparatus or an alternative vessel. Device 300 includes molten metal pump 301 having a base filter 303. Pump 301 directs molten metal to discharge arm 305. Discharge arm 305 in this embodiment is a closed conduit system. Discharge arm 305 can be comprised of a refractory material. Discharge arm 305 can have a length for example of between 5 and 15 feet. Discharge arm 305 can be used to provide a forced flow of molten metal that pours into a shot sleeve, a sand mold, or a tilting permanent mold, as examples. Discharge arm 305 includes a notched position lever 309 useful to adjust the height of the end spout 311, allowing the molten metal to accurately enter a sprue opening and/or pour cup of the molding apparatus. Discharge arm 305 includes a triggering mechanism 307 (a laser in this embodiment) which determines when molten metal has reached the defined location in the arm.

The triggering mechanism can be used to notify the controller when a dosing cycle should be initiated. This provides improved shot weight accuracy and repeatability regardless of metal level in the furnace and how plugged the filter may be.

As an alternative to a laser, a non-contact molten metal switch that is enclosed from the outside environment and can be heated may be employed. Similarly, it is contemplated that a thermocouple or pressure sensor may be used to determine when molten metal is passing through the discharge arm conduit. In these embodiments, an electronic relay would trip when molten aluminum enters the 3-4 inch refractory pipe length adjacent the sensor.

Figure 6:
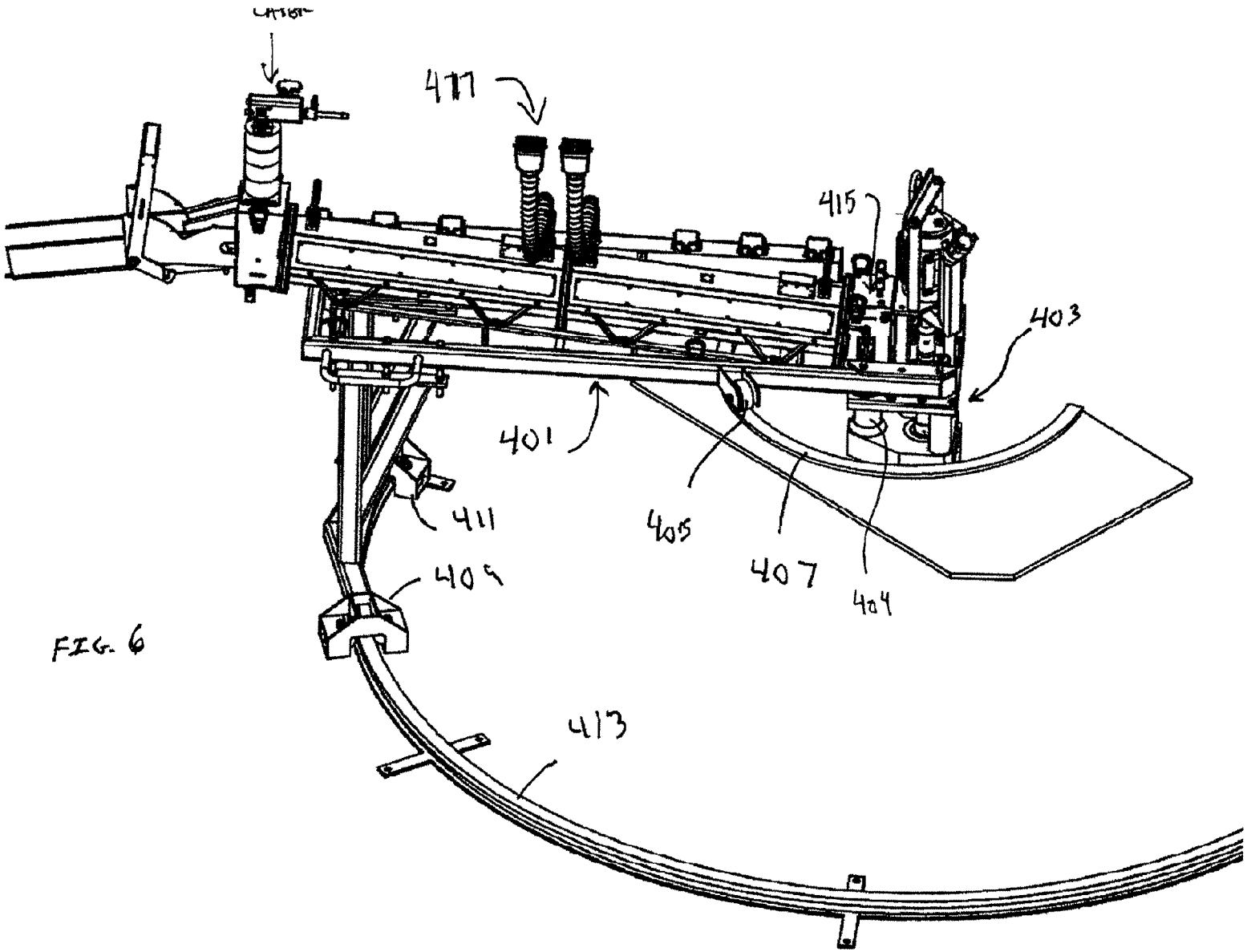
FIG. 6 is a perspective view of an alternative rotatable heated launder tube of the die casting apparatus.

Referring now to FIG. 6, the delivery arm of the die casting apparatus has been modified to include rotational adjustability. Particularly, a portion of discharge arm 401 proximate pump 403 is equipped with roller 405 arranged to engaged track 407. At an end of discharge arm 401 remote from the pump a further roller arrangement 409/411 engages a second track structure 413. A rotable coupling 415 can be employed between discharge arm 401 and a riser 404 of the pump 403. The tracks allow the discharge arm 401 to rotate between the sprue of different molds or to be moved away for maintenance.

The discharge arm 401 is further equipped with heating elements 417 to keep the refractory material of the arm at an elevated temperature, e.g. above 750° C., such that molten aluminum in the discharge arm is prevented from solidifying. The inclusion of heating elements can be particularly beneficial in environments that require a long (e.g. >6 feet) discharge arm.

Figure 7:
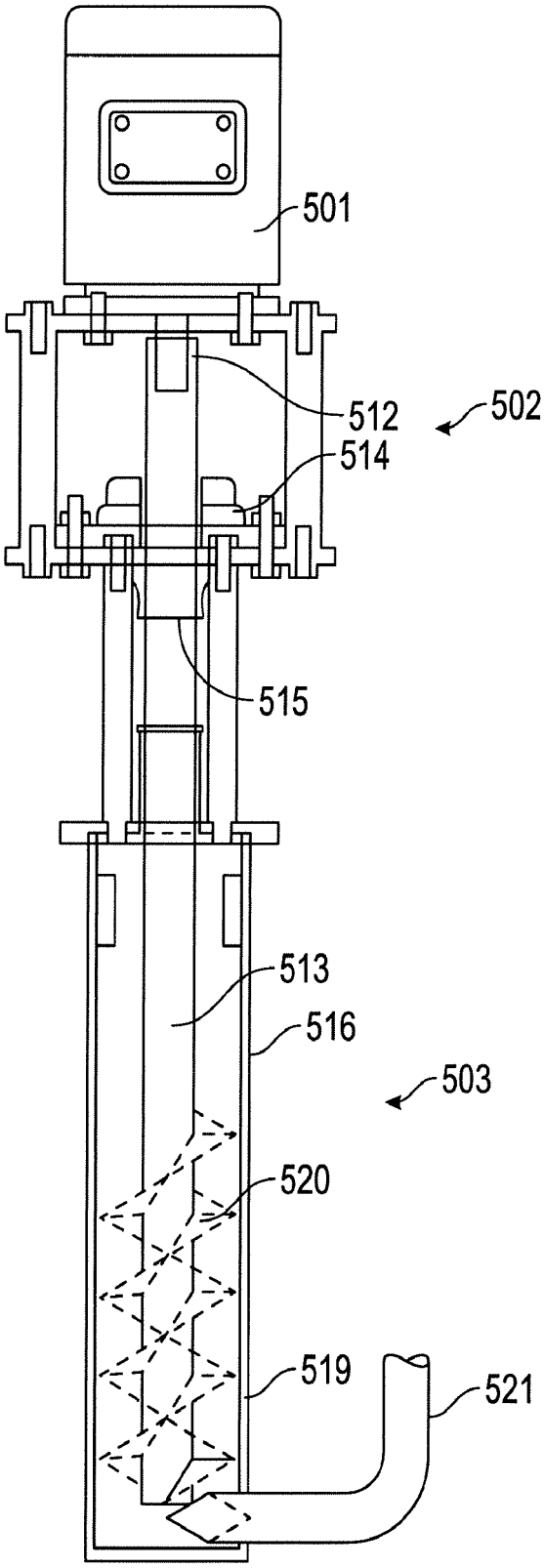
FIG. 7 is a perspective view of a auger (screw) pump suitable for use in the present disclosure.

Referring now to FIG. 7, an alternative pump is depicted and represents a viable option for use in the present disclosure. The pump consists of upper portion 502 which is suspended above a molten metal bath during operation and lower portion 503 which is immersed in the bath. A motor 501 is positioned at the top of the upper portion.

A coupler 512 is attached to an auger shaft 513 and the motor 501. The auger shaft 513 is centered within the internal diameter of the two portions, running the length of both, and is held in position by a set of guide bearings (514, 515). The lower portion is comprised of a cylindrical casing 516 in which an auger 520 is located and aligned. Inlet holes 519 are located in the cylindrical casing near the base of the pump. The inlet holes permit the surrounding molten metal to enter the pump.

The auger 520 acts like a positive displacement pump. Typically, displacement is impeded by slippage of material past the auger. As a result, the rotation of the auger shaft by the motor supplies a steady force to the molten metal, forcing the molten liquid to the bottom of the pump and out of the connector 521. The molten metal displaced to the bottom of the pump is downwardly forced out through the connector by means of the rotation of the auger. The pitch of the auger flutes can vary between 2 to 4 inches, for example, depending on the application. For instance, when a large volume is required, a 4 inch pitch should be used. In contrast, a 2 inch pitch provides the accuracy required to pour a small volume of molten metal.

The connector 521 can be attached to a heated transfer tube which will convey the molten metal from the holding furnace to the die of the casting machine. The triggering mechanism can be associated with a transfer tube or a discharge arm feed thereby.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molding machine comprising a cavity to be filled with molten metal; a conduit system leading to said cavity; a mechanical pump in fluid communication with a reservoir of molten metal and the conduit system; and at least one trigger mechanism in association with the conduit system, said trigger mechanism configured to determine when molten metal has reached a defined point in the conduit system; wherein a controller calculates a quantity of molten metal flow based upon the speed of the motor and wherein said controller calculates an associated time of molten metal pump operation necessary to fill a mold and wherein said trigger mechanism instructs said controller to initiate a countdown of said time.

2. The molding machine of claim 1 wherein said pump includes an electronic brake.

3. The molding machine of claim 1 wherein said controller receives data concerning molten metal depth in said reservoir or an associated furnace.

4. The molding machine of claim 1 wherein said trigger mechanism further calculates a volume of molten metal passing through the conduit system over a fixed period of time.

5. The molding machine of claim 1 wherein said trigger mechanism comprises a laser, a thermocouple, molten metal switch and/or a pressure sensor.

6. The molding machine of claim 1 wherein said pump comprises a centrifugal pump.

7. The molding machine of claim 1 wherein said pump comprises a screw pump.

8. The molding machine of claim 1 wherein the system is closed to the environment between the pump and the cavity.

9. The molding machine of claim 1 wherein a rotatable delivery arm is in fluid communication with a riser of the pump.

10. The molding machine of claim 9 wherein the rotatable delivery arm is supported on a track member.

11. The molding machine of claim 9 including a rotatable coupling disposed between the riser and the rotatable arm.

12. The molding machine of claim 9 including a rotatable coupling disposed between the riser and the rotatable arm.

* * * * *